US009127482B2

(12) United States Patent
Gaj et al.

(10) Patent No.: US 9,127,482 B2
(45) Date of Patent: Sep. 8, 2015

(54) DOOR LOCK DEVICE WITH THERMOACTUATOR FOR HOUSEHOLD APPLIANCES

(75) Inventors: Renato Gaj, Casale Monferrato (IT); Paolo Savini, Casale Monferrato (IT)

(73) Assignee: ELTEK S.P.A., Casale Monferrato (IT)

( * ) Notice: Subject to any disclaimer, the term of this patent is extended or adjusted under 35 U.S.C. 154(b) by 499 days.

(21) Appl. No.: 13/157,855

(22) Filed: Jun. 10, 2011

(65) Prior Publication Data

US 2011/0309638 A1 Dec. 22, 2011

(30) Foreign Application Priority Data

Jun. 18, 2010 (IT) ..... TO2010A0528

(51) Int. Cl.

| | |
|---|---|
| ***E05C 1/06*** | (2006.01) |
| ***E05B 47/00*** | (2006.01) |
| ***E05B 47/02*** | (2006.01) |
| ***A47L 15/42*** | (2006.01) |
| ***D06F 37/42*** | (2006.01) |
| ***D06F 39/14*** | (2006.01) |
| ***D06F 58/04*** | (2006.01) |
| *E05B 15/02* | (2006.01) |

(52) U.S. Cl.

CPC ..... *E05B 47/0009* (2013.01); *A47L 15/4259* (2013.01); *D06F 37/42* (2013.01); *D06F 39/14* (2013.01); *D06F 58/04* (2013.01); *E05B 47/0001* (2013.01); *E05B 47/026* (2013.01); *A47L 2501/22* (2013.01); *E05B 2047/0079* (2013.01); *Y10T 292/08* (2015.04); *Y10T 292/1014* (2015.04)

(58) Field of Classification Search

CPC .. E05B 47/0001; E05B 47/026; E05B 65/104
USPC ..... 292/144, 341.15, 341.16, DIG. 66, 292/DIG. 69, 137, 163, DIG. 51
See application file for complete search history.

(56) References Cited

U.S. PATENT DOCUMENTS

| | | | | | |
|---|---|---|---|---|---|
| 4,111,474 | A | * | 9/1978 | Heydner | 292/144 |
| 4,319,659 | A | * | 3/1982 | Heckelman et al. | 180/271 |
| 4,917,419 | A | * | 4/1990 | Mora et al. | 292/144 |
| 4,995,650 | A | * | 2/1991 | Schantz et al. | 292/201 |
| 5,062,668 | A | * | 11/1991 | Onderka et al. | 292/25 |

(Continued)

FOREIGN PATENT DOCUMENTS

| | | |
|---|---|---|
| DE | 205318 | 5/1972 |
| DE | 42 03 635 A1 | 8/1993 |

(Continued)

OTHER PUBLICATIONS

Search Report dated Apr. 5, 2011 issued in Italy Application No. TO20100528.

*Primary Examiner* — Carlos Lugo
(74) *Attorney, Agent, or Firm* — Workman Nydegger

(57) ABSTRACT

The invention relates to a door lock device for household appliances such as washing machines, clothes dryers and the like. The device comprises a slide (6) which is movable between a door lock position and a door unlock position, and which cooperates with a coupling tooth arranged on the door in order to hold the door locked when the household appliance is in operation. The device is fitted with a thermoactuator (4) that drives the slide (6) by imparting thereto a translational motion between a door lock position and a door unlock position.

16 Claims, 7 Drawing Sheets

(56) References Cited

U.S. PATENT DOCUMENTS

| | | | | |
|---|---|---|---|---|
| 5,249,831 | A * | 10/1993 | Maniaci | 292/144 |
| 5,263,347 | A * | 11/1993 | Allbaugh et al. | 70/257 |
| 5,386,713 | A * | 2/1995 | Wilson | 70/280 |
| 5,473,922 | A * | 12/1995 | Bair et al. | 70/416 |
| 5,791,179 | A * | 8/1998 | Brask | 70/278.1 |
| 5,823,026 | A * | 10/1998 | Finke | 70/276 |
| 5,862,693 | A * | 1/1999 | Myers et al. | 70/278.1 |
| 6,098,433 | A * | 8/2000 | Maniaci | 70/278.1 |
| 6,299,222 | B1 * | 10/2001 | Atmodimedjo | 292/144 |
| 6,345,848 | B1 * | 2/2002 | Baader et al. | 292/341.16 |
| 6,527,310 | B1 * | 3/2003 | Bellamy | 292/144 |
| 6,871,519 | B2 * | 3/2005 | Butera et al. | 70/256 |
| 6,886,868 | B2 | 5/2005 | Hengelein et al. | |
| 7,059,159 | B2 * | 6/2006 | Lanigan et al. | 70/280 |
| 7,540,176 | B2 * | 6/2009 | Arriola Arrizabalaga et al. | 70/208 |
| 7,585,006 | B2 * | 9/2009 | Alacqua et al. | 292/341.16 |
| 7,625,019 | B2 * | 12/2009 | Alacqua et al. | 292/137 |
| 7,647,797 | B1 * | 1/2010 | Viso Cabrera et al. | 70/208 |
| 7,900,979 | B2 * | 3/2011 | Bragg et al. | 292/137 |
| 8,245,549 | B2 * | 8/2012 | Zagoroff | 70/283 |
| 8,403,376 | B2 * | 3/2013 | Greiner et al. | 292/144 |
| 2005/0110279 | A1 * | 5/2005 | Kalsi | 292/144 |
| 2005/0167992 | A1 * | 8/2005 | Lo et al. | 292/251.5 |
| 2010/0270817 | A1 * | 10/2010 | Yu | 292/251.5 |

FOREIGN PATENT DOCUMENTS

| | | | |
|---|---|---|---|
| DE | 202 16 614 | U1 | 3/2003 |
| EP | 0 965 677 | A1 | 12/1999 |
| EP | 1 314 840 | A2 | 5/2003 |
| EP | 1 467 048 | A1 | 10/2004 |

* cited by examiner

DOOR LOCK DEVICE WITH THERMOACTUATOR FOR HOUSEHOLD APPLIANCES

CROSS-REFERENCE TO RELATED APPLICATIONS

This application claims the benefit of Italian Application No. TO2010A000528 filed on Jun. 18, 2010, which applications is hereby incorporated by reference.

BACKGROUND OF THE INVENTION

1. The Field of the Invention

The present invention relates to a door lock device for a household appliance, in particular a washing machine.

2. The Relevant Technology

As known, in clothes washers and/or dryers, dishwashers, ovens and other household appliances fitted with a door accessible from the outside there is a safety device that prevents the door from opening when the appliance is in operation.

This may be for safety reasons, since in the case of a clothes washer someone could otherwise open the door and cause damage due to water coming out or injury to the user if a spin cycle is going on, or for reasons related to the timed operation of the household appliance, e.g. in the case of gas or microwave ovens carrying out cooking cycles whose duration is set by the user.

These devices which carry out such functions in the various household appliances are commonly called "door locks"; for simplicity, this definition will therefore be used in the following description and in the appended claims.

As can be easily understood, said devices may have several configurations depending on the type of household appliance they are intended for; however, it can be stated that they essentially comprise a latch connected to a mechanism, which cooperates with the door of the household appliance to lock it.

The mechanism, that is driven by an actuator, may be quite complex and may include many elements, such as sliders, ratchets, countersprings, reducing gears and the like, depending on design choices, whereas the actuator is typically an electromagnet or a thermoactuator.

The latter is controlled by the household appliance's control system, which coordinates its operation with the general operation of the washing machine, dishwasher, oven or the like where it is installed.

In some door lock types, like the one described in European patent application EP 1 467 048, the mechanism comprises a movable element, such as a latching slide, which under the countering action of elastic means, generally a spring, engages with a homologous element of the door (a hook or an aperture, as the case may be): the actuator locks/unlocks the movable element depending on the cycle step being carried out, by engaging it with the homologous one on the door and thus locking/unlocking the latter.

The movable element of the device is held in the door lock condition for the time set by the household appliance's control system, which will then activate/deactivate the actuator in order to have it make a reverse movement thereby allowing the door to be opened.

In the reverse step, the actuator arms the door lock device again by loading the elastic means, which are then ready for the next operating cycle.

From a functional viewpoint, the door lock devices referred to above have been extensively tested and meet the requirements they are intended for; however, their construction is rather complex, in that the mechanism associated with the actuator must allow closing the door (like any door latch) while at the same time preventing unauthorized opening depending on the cycle steps being carried out by the household appliance.

This involves the presence of additional components, such as reducers or mechanical transmissions or the like, the operation of which must be coordinated with that of the movable element in order to enable the door opening and closing movements.

As can be easily understood, the presence of such additional components makes the door lock device more complex and, as a result, rather bulky.

Furthermore, in the case of clothes washers the operation of the door lock device may be impaired by formation of detergent scale on the mechanical components thereof, leading to easily imaginable problems.

For example, a hardened detergent deposit may be formed on the hook or on the slide aperture, which in the engaged condition will change the position of the slide, resulting in the risk that the door will not lock properly because the actuator does not act upon the slide as it should.

Different solutions are also known in the art, like the one disclosed in European Patent No. 965 677.

In this solution, the slide is moved by the hook as the latter is inserted into the window, until it reaches a working position wherein it can be locked, so as to hold the hook in position and prevent the door from opening.

As can be easily understood, the proper operation of this solution is however strictly dependent on the correct positioning of the hook with respect to the slide when the door is closed.

A wrong position will in fact cause the slide to move too little, thus not reaching the position where it can be locked; this will prevent locking of the hook and will compromise the safety of the machine on which such a device is installed.

This problem is even more felt when the door and/or the seat of the door lock device are made of plastic, as is often the case as far as clothes washers are concerned.

In this case, indeed, the hook is frequently manufactured as one piece with the door during a single moulding process.

The shrinking of the plastic material occurring after said moulding process may cause an inaccurate positioning of the hook, leading to the risk that the above-described door lock device will not work properly due to an improper movement of the slide to the lock position.

Moreover, the plastic material is subject to deformation over time, which may cause the hook to be relocated, thereby bringing about the above-mentioned consequences.

In this regard, it should be noted that said problems are even more important when a top-loading washing machine is concerned.

In these machines, in fact, the door is very large and is therefore almost always made of plastic in one piece with the hook, as described above.

The large dimensions of the door, combined with the facts that the door hinges are also made of plastic and that the hook is typically arranged on the side opposite to the hinges' side, often cause the hook to be improperly relocated as it is inserted into the slide window; as a consequence, the operation of the door lock device may easily be jeopardized.

The different shrinking of the plastic material of the door and of the hook following the moulding process and the variability in the door lock device's mounting position make the situation even worse.

Taking into account also possible deformations deriving from operating circumstances (such as heat or careless use), it is apparent that these devices are subject to the influence of many variables which may compromise their operation, if the position of the hook and the position of the slide are not accurate.

It must also be pointed out that an inaccurate positioning implying, for example, an improper interfacing between the hook and the window, cannot generally be rectified by simply using the force applied by the actuator, because in these applications the latter typically consists of an electromagnet exerting a rather small force, not capable of forcing the slide to the correct locking position in the event that, for any reason, it is engaged by the hook in an incorrect position.

What is more, this problem cannot be overcome by simply providing a larger window on the slide, since in such a case the actuator will not be able to lock the slide properly because the slide will still have a certain travel tolerance after locking has occurred and may disengage when the door is pulled.

Any detergent scale will only make things even worse, in particular as far as top-loading washing machines are concerned, where such scale is more likely to form because some detergent may inadvertently fall into the door lock as the dispenser is being filled and/or as it is being inserted into the drum.

SUMMARY OF THE INVENTION

The technical problem underlying of the present invention is therefore to improve this state of the art.

In other words, the problem is to provide a door lock device, intended in particular, but not exclusively, for household appliances such as clothes washers, clothes dryers and the like, whose structural and operating features are such as to overcome the above-mentioned drawbacks of prior-art devices.

The idea to solve this problem is to provide a door lock device wherein the actuator, besides controlling the movable element that engages with the door, also prevents it from making any movements not enabled by the household appliance's control system.

To this end, in accordance with a preferred embodiment the actuator is connected to the movable element without any intermediate mechanical transmission systems, so that it is the actuator itself that directly controls the movable element.

Preferably, the actuator is so configured as to allow linear movements alternated with predefined end-of-travel points, thereby eliminating the need for using any external stop means acting upon the movable element, in order to stop the travel thereof.

The aforementioned technical problem is solved by a door lock device having the features set out in the appended claims.

BRIEF DESCRIPTION OF THE DRAWINGS

Such features and the advantageous effects resulting therefrom will become more apparent from the following description of a preferred but non-limiting embodiment and a variant thereof, as shown in the annexed drawings, wherein.

DETAILED DESCRIPTION OF THE PREFERRED EMBODIMENTS

Figure 1:
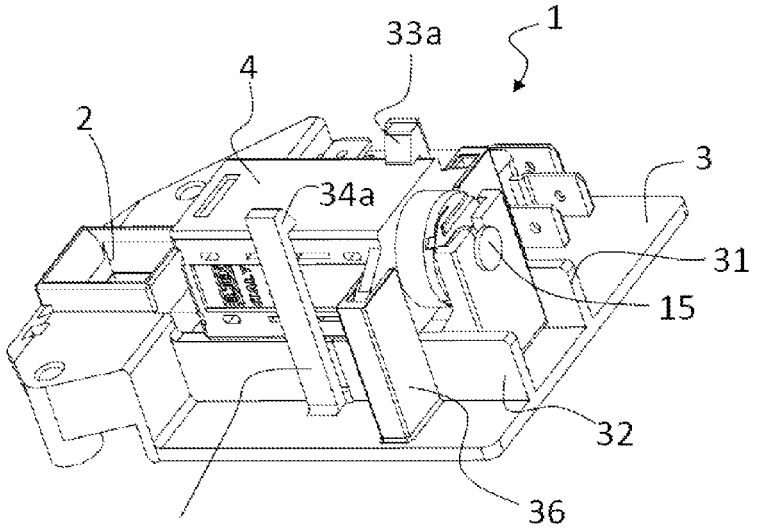
FIGS. 1 and 2 show an axonometric view from respective opposite sides of a door lock device according to the invention.
Figure 2:
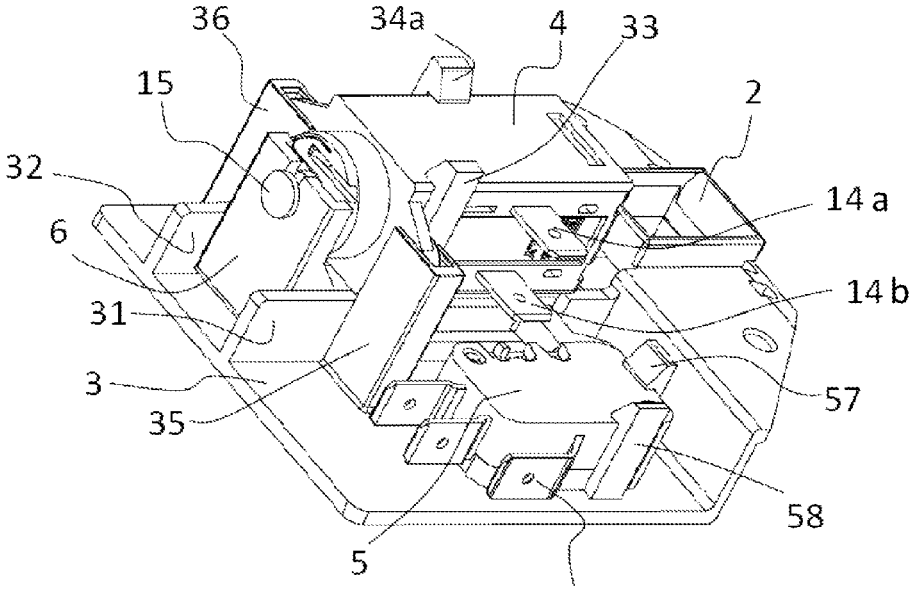

With reference to the above-listed drawings, reference numeral 1 designates as a whole a door lock device preferably intended for a washing machine; for simplicity, the latter is not shown in the drawings, but it is of the type wherein the door is fitted with a coupling tooth D to be engaged into an aperture 2 of the door lock device.

Figure 7A:
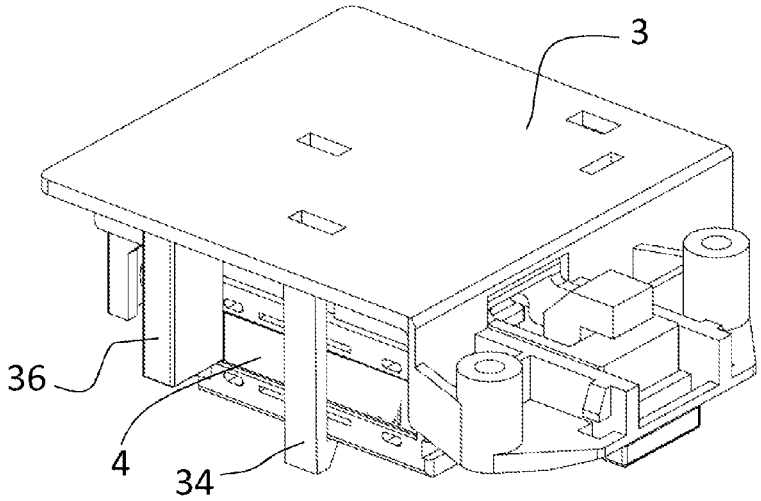
FIGS. 7*a* and 7*b* show a bottom view of the device of the preceding figures, in respective operating conditions corresponding to those of FIGS. 3 and 5.
Figure 7B:
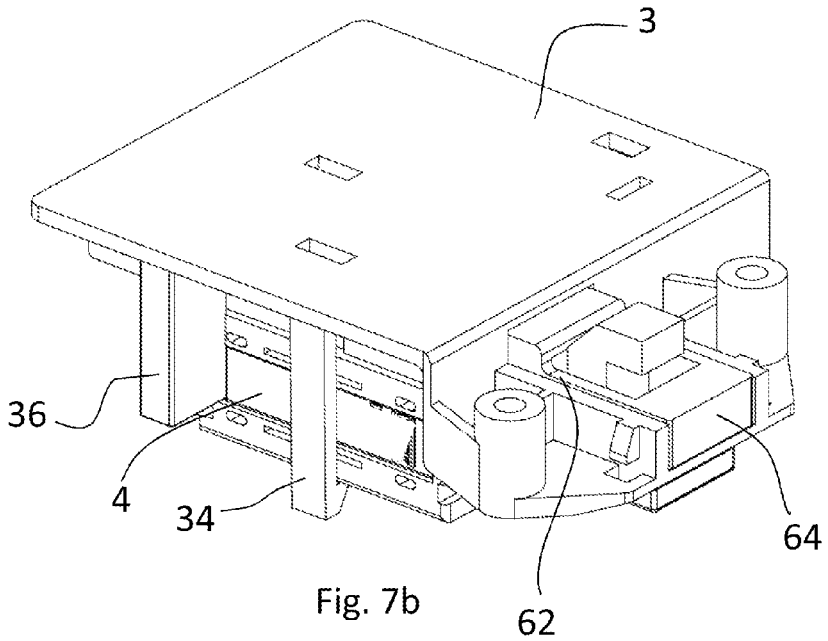

The device 1 comprises in this case a base plate 3 on which the various components shown separately in FIG. 7 are mounted, including a thermal or thermoelectric actuator 4 (hereafter referred to as thermoactuator), a switch 5 and a slide 6.

Figure 9A:
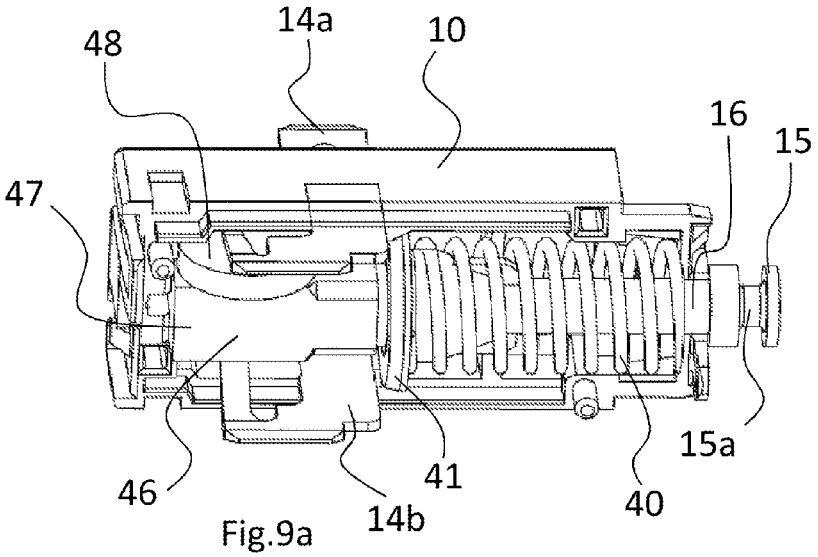
FIGS. 9*a* and 9*b* show a partially sectional view of a thermoactuator of the device shown in the preceding FIGS., in respective operating conditions.
Figure 9B:
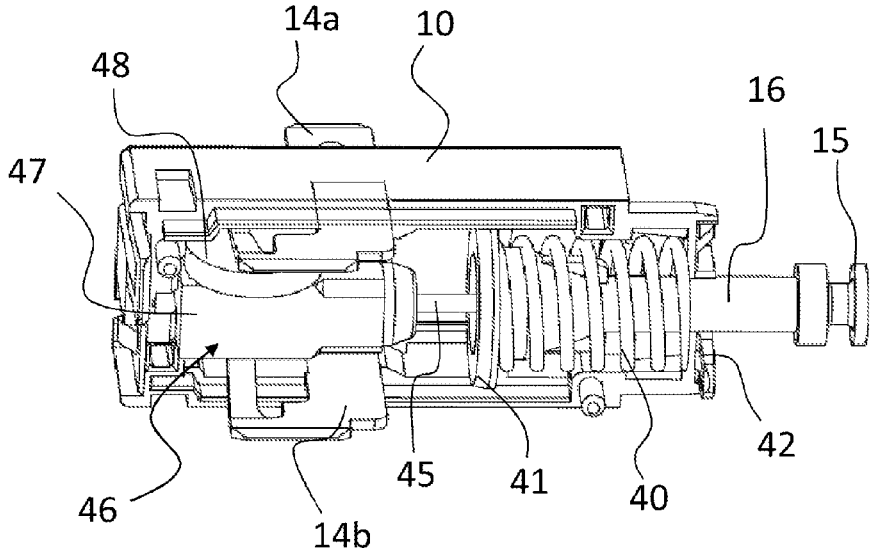

The thermoactuator 4 is of the type wherein an expandable material, such as wax or the like, expands when heated, thus promoting the axial movement of a stem or a piston, that may take at least two predetermined working positions: one in which it is retracted into the actuator and one in which it is extracted from the actuator, respectively shown in FIGS. 9*a*, 9*b*.

The construction details of the actuator 4 will be further described below. At this point, it should only be added that it comprises an external body 10 being substantially a parallelepipedon in shape, preferably formed by two body portions being in particular equal or symmetrical to each other, and having two clamping projections or wings 11, 12 protruding from respective opposite sides for its installation onto the base plate 3, as will be better explained later on.

On one side of the body 10 there are also a pair of electric contacts 14*a*, 14*b* through which the actuator 4 can be electrically connected to the system of the household appliance where it has been installed. Thus, the expanding material or wax inside the thermoactuator can be heated by an electric heater in order to produce the expansion necessary for moving the stem 16.

A head 15 of the piston 16 protrudes from one end of the body 10 of the thermoactuator, which piston is driven by the wax expanding inside the body 10 as mentioned above.

In this case, the head 15 protrudes from the end of the thermoactuator 4 on the side opposite to the aperture 2 of the door lock, and is shaped with a neck 15*a* that allows it to engage with the slide 6, which will be discussed later on.

The head 15 may however have a different shape than the one shown herein; for example, it may have an at least partially spherical shape, suitable for being coupled with a homologous seat, much like ball joints or articulations.

More in general, it can be stated that the stem 16 and the slide 6 may include coupling means which may take many different shapes while still providing the same functions, which will become apparent in the course of the present description.

The thermoactuator 4 is mounted onto a seat 30 provided on the plate 3, and defined by at least two opposed projections or walls 31, 32; in particular, the body 10 of the thermoactuator rests on said walls 31, 32, against which it is held in position by two coupling appendices 33, 34 extending vertically from the plate 3.

In practice, the thermoactuator 4 is mounted by inserting it between the appendices 33, 34, preferably with a movement substantially orthogonal to the axis of motion of the slide 6 or downwards from above, with reference to the annexed exemplificative drawings, which appendices 33, 34 stretch apart slightly in an elastic manner and then close back in, so that their heads 33*a*, 34*a* can clamp the body 10 of the thermoactuator, as shown in the drawings.

At the same time, the proper positioning of the thermoactuator's body 10 in the longitudinal direction relative to the seat 30 is ensured by its protruding wings 11, 12 engaging into the vertical guide seats or columns 35, 36.

On the plate 3, adjacent to the thermoactuator 4, there is further a switch 5, also of a per se known type, intended for transmitting electric signals to the door lock device control system through the electric system (not shown in the drawings), to which it is connected through the electric contacts 50, 51 and 52; for this purpose, the switch 5 comprises a push-button 55 which is pressed by the slide 6 during its movements, which will be further described later on.

For now, suffice it to say that the switch 5 is held in position on the plate 3 by vertical coupling appendices 57 and 58 similar to those previously described with reference to the thermoactuator 4, which operate on the outer edge or profile of the switch 5 itself in combination with vertical fixing pegs 59 or holes 56 of the switch 5.

Under the latter, the seat 30 defined between the walls 31, 32 slideably houses the slide 6, which, as aforesaid, is coupled to the head 15 of the stem 16 of the thermoactuator 4.

For this purpose, at one end of the slide 6 there is a groove 60 into which the neck 15*a* of the head 15 is inserted; the groove 60 and the neck 15*a* of the head 15 constitute the above-mentioned complementary coupling means, which connect together the stem 16 and the slide 6.

The slide 6 also features a protruding wing or projection 61 on one of its sides and a window 63 in a step-like portion 62.

Referring back briefly to the above, the thermoactuator 4 can take two predetermined stable operating conditions, in a first one of which the actuator 4 is not heated or receives no electric power, whereas in a second one it is heated and electrically powered.

In the first condition the stem 16 is retracted into the body 10 (FIG. 9*a*), whereas in the second condition the stem 16 is extracted therefrom (FIG. 9*b*).

To this end, a coil spring 40 is arranged coaxially around the stem 16. In the retracted and extracted conditions of the stem, this spring is mounted and/or partly compressed between a base plate 41 of the stem and an end wall 42 of the actuator body 10.

The plate 41 is in its turn associated or integral with a piston 45 that comes out of a chamber 46 containing a known thermally expandable material, such as a wax.

The chamber 46 comprises an outer wall 47 made of metallic material and electrically connected on one side to a first electric contact 14*a* and on the other side to an electric heater or resistor 48, provided in the form of a disc; the latter is then also connected to a second electric contact 14*b*.

The wall 47 of the chamber 46 is then electrically connected to at least one of the contacts 14 (i.e. 14*a*, 14*b*) of the actuator 4, so as to supply power to the resistor 48 which, in a preferred but non-limiting embodiment, is a PTC (Positive Thermal Coefficient) resistor.

The chamber 46 contains the expandable wax already referred to above, and partially houses the piston 45, which is directly in contact with said material; for this purpose, between the wall 47 of the chamber 46 and the piston 45 there are suitable sealing means, such as metallic and/or elastomeric washers, gaskets and/or O-rings.

The piston might however be kept separate from the expandable material by suitable insulating and sealing means.

As can be easily understood, when electric power is supplied to the actuator 4 starting from the condition of FIG. 9*a*, wherein the stem 16 is retracted into the body 10, the wax inside the chamber 46 expands; therefore, starting from an initial condition wherein the spring 40 is idle or only slightly compressed, the piston 45 comes out of the chamber 46 under the thrust of the expanded wax and pushes the plate 41 towards the end of the body 10.

The movement of the plate 41 in turn pushes the stem 16 out of the body 10, thereby compressing the spring 40 against the end wall 42 thereof: the actuator 4 remains stable in this condition (FIG. 9*b*), with the stem 16 in the extracted condition, until the power supplied to the device control system is cut off.

At this stage, i.e. after the wax in the chamber 46 of the thermoactuator 4 has cooled down, the force of the spring 40 overcomes the resistance of the thermally expandable material inside the chamber 46, thus returning the actuator into its initial condition by causing the stem 16 to go back, at least partially, into the body 10.

From the above description it is possible to understand the operation of the door lock device 1, which is as follows.

The slide 6 moves longitudinally in the seat 30, delimited by the walls or guide means 31, 32, integrally with the stem 16 of the thermoactuator 4, to which it is connected through the engagement between the groove 60 and the neck 15*a* of the head 15.

Figure 3:
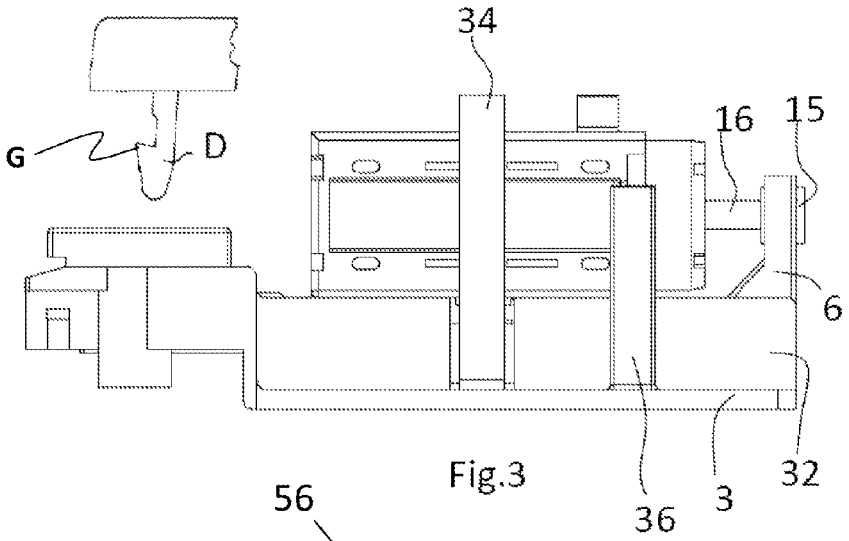
FIGS. 3 and 4 show a side view and a plan view, respectively, of the device shown in the preceding figures, in a first operating condition.
Figure 4:
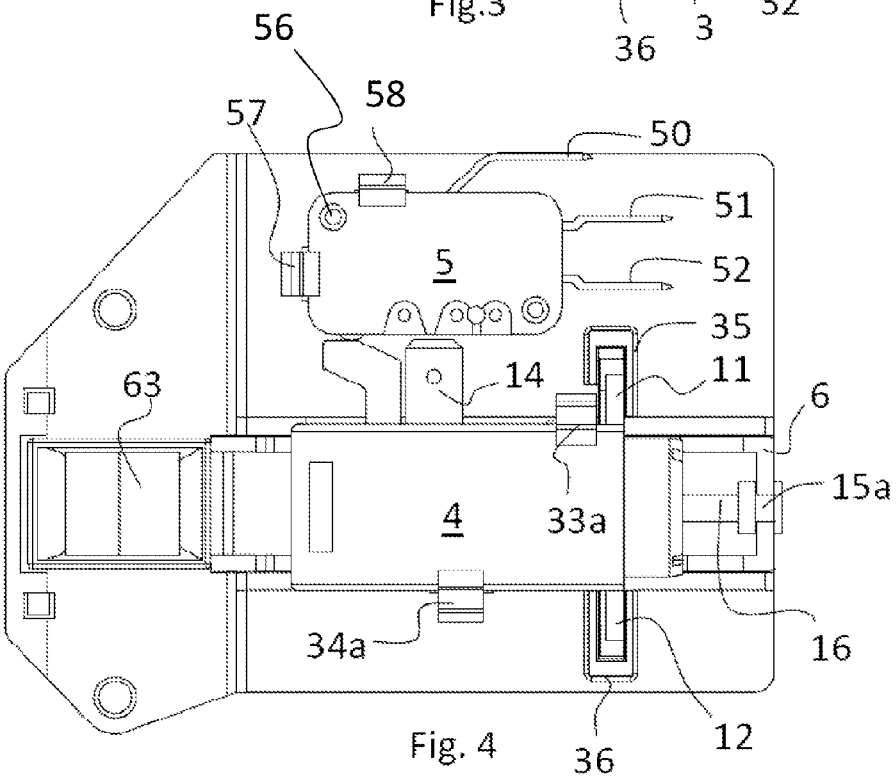

Therefore, when the stem is in the condition wherein it is extracted from the body 10, as shown in FIGS. 3 and 4, the slide 6 is in the forward position (to the right in FIG. 3, 4), with the window 63 not aligned with the aperture 2 of the device, i.e. with one end or edge 64 of the slide 6 engaging at least a portion of the aperture 2 and/or at least a portion of the coupling tooth D, when the latter is present in the aperture 2; in this condition, the slide 6 can keep locked the coupling tooth D of the door of a washing machine, which is only partially shown in the drawings.

In fact, the edge 64 of the step-like portion 62 of the slide 60 prevents the tooth D from coming off, because it is suitably shaped with a hooking end G that stops the opening movement of the door.

In this condition, it must be emphasized that the actuator 4 directly forces the slide 6 against the coupling tooth D, while being able to adapt itself to the position of the latter and/or to move it appropriately. In other words, if we consider the force of the thermoactuator 4, when the coupling tooth D is positioned incorrectly (e.g. because of tolerances or deformations of the plastic), it can nevertheless be moved or repositioned by the thrust exerted by the thermoactuator, thereby obtaining some sort of self-adjustment of the door lock with respect to the coupling tooth.

Furthermore, in this operating condition of the device 1, the wing 61 of the slide 6 holds down the push-button 55 of the switch 5: the latter can then send a signal to the household appliance's control system to indicate the door locked state.

Figure 5:
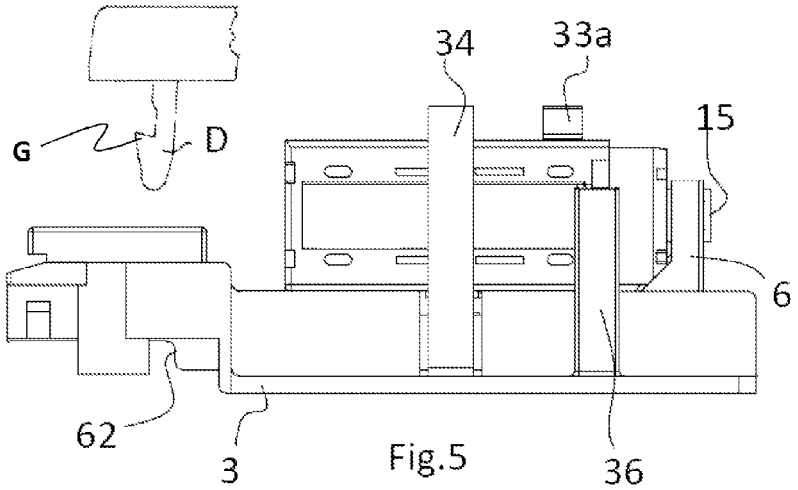
FIGS. 5 and 6 show, in views like those of FIGS. 3 and 4, the same device in a second operating condition.
Figure 6:
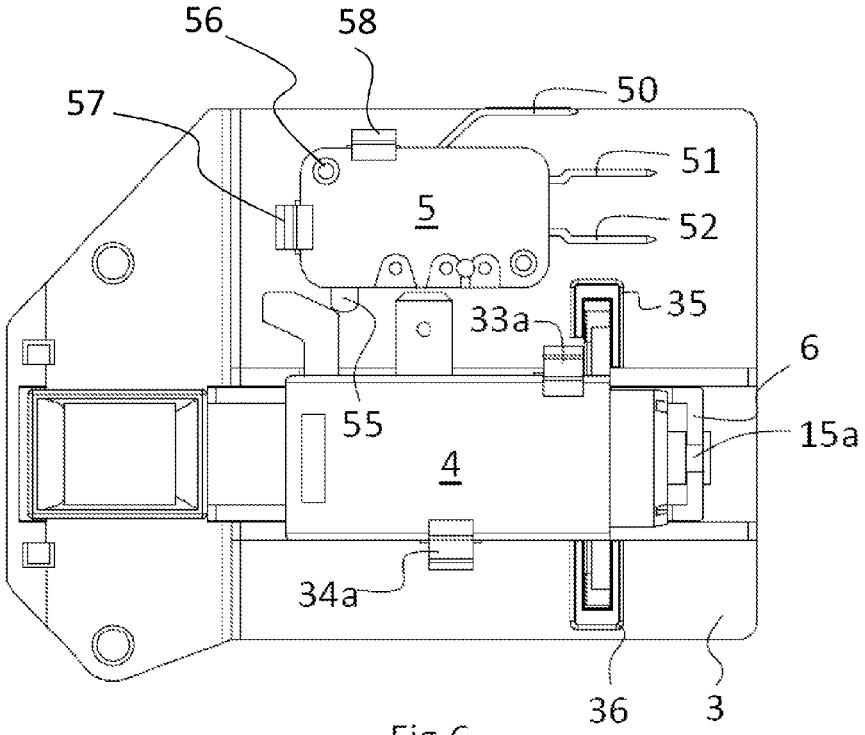

When the door is to be opened, the control system of the device 1 controls the return stroke of the stem 16 of the thermoactuator 4 so as to bring it back into the retracted condition of FIGS. 5 and 6.

The slide 6 moves integrally with the stem in a manner inverse to the above, in particular under the force exerted by the spring 40 of the thermoactuator 4, thereby bringing the window 63 in alignment with the aperture 2 of the device: in this condition the tooth D is free to move and the door, with which it is associated, can be opened.

At the same time, the push-button 55 of the microswitch 5 is also released by the protruding wing 61 of the slide, so that also this operating condition of the door lock device 1 is signalled to the household appliance's control system.

It should only be added that the retracted condition of the stem 16 of the thermoactuator 4 is also stable, and therefore the device requires no additional means to ensure that the door can be opened.

As is apparent from the above description, the door lock device 1 solves the technical problem underlying the invention.

In fact, its movable part (i.e. the slide 6 with the window 63) that engages the corresponding element of the door (i.e. the coupling tooth D) is integral with the stem of the actuator 4: the structure of the door lock device is thus much simplified, considering also that the actuator 4 operates between two predefined working positions.

These functional features, in fact, allow to avoid using springs or other elements for holding the slide in the end-of-travel positions, that would have to be arranged outside the device and would therefore be subject to the same problems suffered by the prior art (e.g. detergent scale deposits, shocks, etc.).

In this frame, it must be underlined that the use of a thermoactuator as the one considered herein allows a force to be applied onto the coupling tooth D of the door that keeps the latter firmly locked, even if an attempt is made to force it open.

As a matter of fact, thermoactuators of this type are characterized in that they stably hold the stem in the condition wherein it is extracted from or retracted into the body, so that its position cannot be changed from the outside, as would be the case if someone wanted to open the door by forcing the lock device 1.

In other words, the choice of a thermoactuator as previously explained allows to eliminate any ratchets or other equivalent mechanisms intended for preventing a backward movement of the slide that is locking the door, as opposed to prior-art devices, wherein the actuators cannot exert sufficient force to prevent the door from being forced open.

The device according to the invention is therefore not only simpler and smaller, but is also more reliable and offers better performance.

The advantageous effects are further amplified by the particularly compact configuration of the example shown, wherein the thermoactuator 4 is arranged over of the slide 6, i.e. substantially within the outer dimensions of the latter: in this way, the overall plan dimensions of these components are defined by the travel of the slide 6.

Of course, the invention may be subject to many variations with respect to the description provided so far.

For example, the thermoactuator 4 may have different configurations which allow the stem 16 to take at least two stable positions, one extracted from the actuator body and one retracted into it; some examples of such configurations are described in European patent applications EP 781 920 and EP 953 198 by the present Applicant.

Indicatively, the shape of the slide and the relative position of the actuator may be different; for example, the position of the microswitch 5 may be exchanged with that of the actuator 4: the latter will still have a stem 16 with a head 15 engaging with the slide, in particular with a lateral appendix 61 of the slide 6, which in such a variant will be arranged alongside the actuator.

This will imply the need of changing the shape of the slide in such a way as to allow it to be connected with the head 15 of the stem, without however altering the substance of the device; such a slide will be so shaped as to include an additional projection 61 adapted to cooperate with the push-button 51 of the switch 5.

If one wants to keep the actuator 4 over the slide 6, according to another possible variation it is conceivable to invert the positions of its ends: the one with the head 15 of the stem 16 could thus be arranged towards the aperture 2 of the plate 3.

Of course, in such a case the arrangement of the slide 6 should be reversed as well, so that the end with the groove 60 will also be concordant with the stem 16.

According to a further possible variant, the push-type thermoactuator 4 described above could be replaced with a pull-type thermoactuator, i.e. fitted with a stem that when the actuator receives power, will tend to retract into the actuator body (instead of coming out, like the one of the preceding case).

Other possible variations may include an actuator 4 of a type other than thermal; however, thermoactuators should be preferred for the reasons explained above, with the addition of their characteristic quietness.

It should also be taken into account that the above considerations also apply, mutatis mutandis, to door lock devices wherein the movable element comprises a hook that engages into a homologous element of the door, consisting of an aperture.

Figure 8:
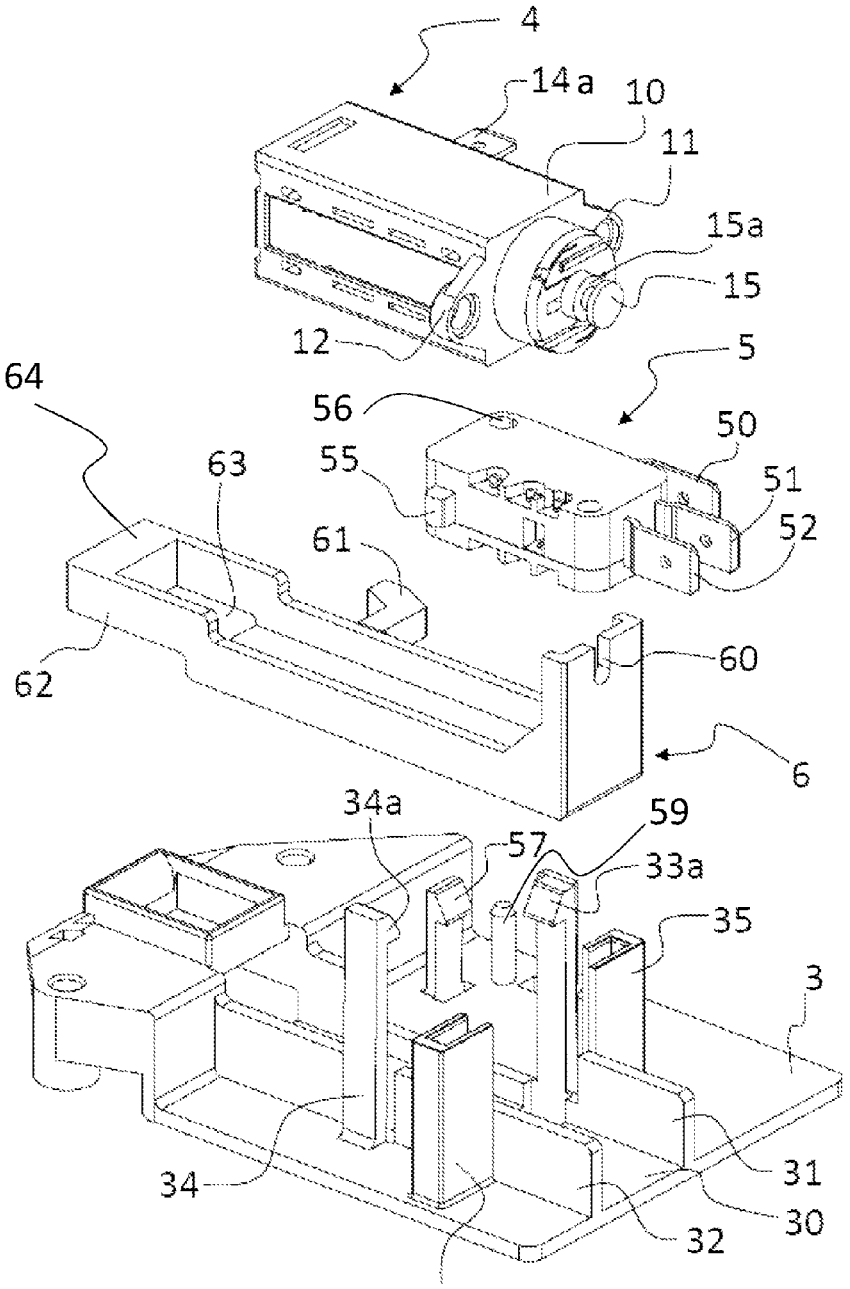
FIG. 8 is an exploded view of the preceding device.

A solution of this kind is shown in FIG. 8, wherein items which are structurally or functionally equivalent to those already described are designated by the same reference numerals with the addition of an apostrophe.

As can be seen, in this case the movable element cooperating with the door (not shown in the drawing) is a square-shaped ("L") lever 6' oscillating about a hinge fulcrum 70' and fitted with a hook-like end 73': the latter is meant to engage into an aperture provided in the door for locking it, according to known principles which for the sake of brevity will not be described any further.

The oscillating lever 6' is driven by the stem 16' of the thermoactuator 4', whose head 15' is shaped like a pin that engages into a groove 60' provided on the portion of the lever 6' opposite to the end portion 73'.

Figure 10:
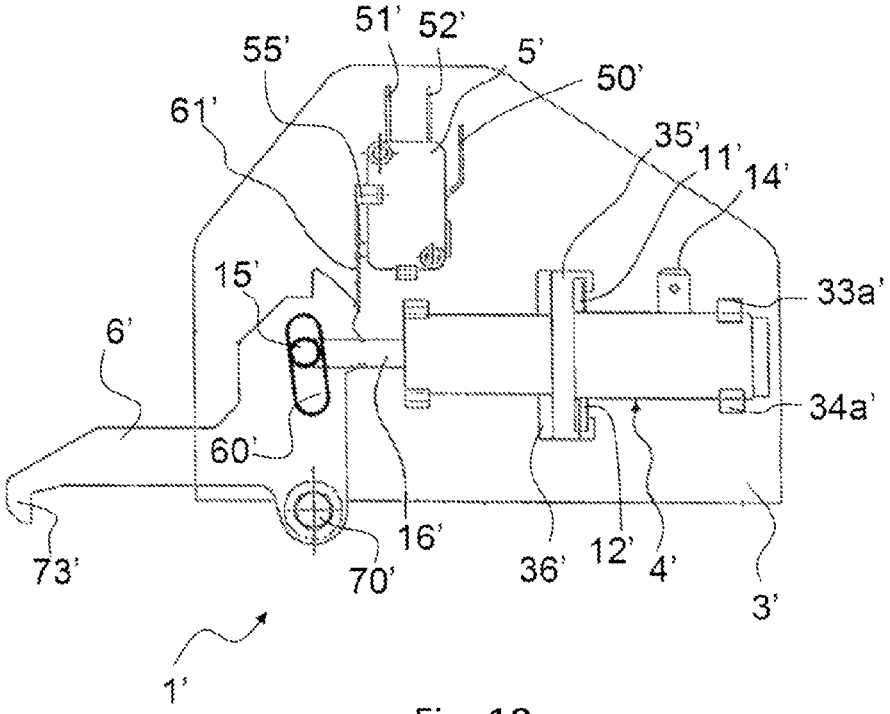
FIG. 10 shows a variant of the device of the preceding figures.

In this variant of the invention, in order to lock the door of the household appliance the actuator 4' moves the stem 16' to the extracted position, so that its head 15' will advance horizontally (to the left in FIG. 10).

The pin 15' of the head will thus slideably engage into the groove 60' of the lever 60, much like a connecting link: as a consequence, the lever 6' will oscillate counterclockwise (in FIG. 10) with respect to its fulcrum 70', so that the end 73' can engage into the homologous aperture in the door (not shown in the drawings because per se known) to lock the latter.

When opening the door, the operation of the device 1' will be reversed.

Therefore, the actuator 4' will cause the stem 16' to retract into the body 10' and, as a result, the lever 6' will turn clockwise (with reference to FIG. 10), so that its end 73' can disengage from the aperture in the door of the household appliance.

As can be easily understood, also in this variant the actuator 4' transmits the motion to the lever 6' from the door lock position to the door unlock position and vice versa; no elastic countering elements, such as springs or the like, are therefore needed for having the movable element 6' (i.e. the lever) perform the forward and return strokes.

This increases the reliability of the door lock device, besides reducing the number of mechanical components thereof to advantage of both reliability and compactness.

In this context, it must be underlined that the actuator 4' is directly connected to the movable element 6' without the presence of any cam mechanisms, reducers or elastic countering means: it follows that the movable element 6' is de facto integral with the stem 16' of the actuator 4'.

The end-of-travel positions of the latter are then transmitted to the movable element 6', which, through the push-button 55' of the microswitch 5, will transmit them to the control system of the door lock device.

In this case as well, the actuator 4' is preferably of a type capable of taking two stable working positions; more preferably, it is of the thermal type (e.g. like the one taken into consideration above or as described in EP 781 920 o EP 953 198 to the present Applicant), wherein the extracted and retracted positions of the stem 16' correspond to the expanded and shrunk positions of the wax within it.

All of the above-described variants and any other variants equivalent thereto will still fall within the scope of the appended claims.

These include, therefore, all possible applications of the device of the invention, which preferably relate to household appliances such as washing machines, in particular top-loading ones, as well as ovens and the like.

Furthermore, although reference has been made in the present description to the fact that the devices 1, 1' are installed on the household appliance, this should not be considered to be a limitation, in that they may alternatively be applied to the door of a household appliance.

In such a case the movable element 6, 6' of the device applied to the door of the household appliance will engage into a corresponding element provided on the structure of the latter.

What is claimed is:

1. A door lock device for a household appliance, the device comprising:

an element, that comprises a slide, movable between a door lock position and a door unlock position and which is adapted to cooperate with a homologous element arranged on the door or on the household appliance structure in order to lock or unlock the door, a plate that includes a pair of opposed walls and at least part of a coupler, wherein a seat provided on the plate is defined at least in part by the pair of opposed walls and is configured to house the moveable element, and a thermoactuator for driving the movable element, the thermoactuator including a thermally expandable material, wherein the thermoactuator moves the movable element between the unlock position and the lock position as a result of the expansion and contraction of the thermally expandable material, wherein the thermoactuator is positioned to rest over the opposed walls and is held by a guide structure and the coupler against the pair of opposed walls such that the thermoactuator is arranged alongside or over the slide and at least a part of said seat such that overall plan dimensions of the device are reduced.

2. A device according to claim 1, wherein the thermoactuator is connected to the movable element and moves integrally therewith.

3. A device according to claim 1, wherein the thermoactuator comprises a movable part adapted to take stable positions corresponding to the door lock and unlock positions of the movable element.

4. A device according to claim 3, wherein the movable part comprises a stem directly connected to the door lock movable element with no intermediate drive mechanisms.

5. A device according to claim 4, wherein the stem is slideable between an extracted position and a retracted position relative to the body of the thermoactuator, which is integral with the movable element in order to move the movable element from said lock position to said unlock position and vice versa.

6. A device according to claim 5, wherein the extracted and retracted positions of the stem of the thermoactuator are stable.

7. A device according to claim 1, wherein the sliding direction of the slide is parallel to a longitudinal direction of the thermoactuator.

8. A device according to claim 1, wherein the slide comprises at one end means for coupling the slide to a stem of the thermoactuator, the means for coupling the slide including a groove associated with a head of the stem of the thermoactuator, so as to move substantially integrally therewith.

9. A device according to claim 1, wherein the slide comprises a window adapted to cooperate with a tooth of a household appliance's door in order to lock and unlock the door.

10. A device according to claim 1, wherein the thermoactuator comprises elastic means which cooperate with a stem to bring the stem into at least one of said door lock and unlock positions in a stable manner.

11. A device according to claim 1, wherein the movable element or the slide is slideably housed in the seat.

12. A device according to claim 1, wherein the thermoactuator is held in position by the coupler to prevent the movable element from being raised with respect to the housing seat.

13. A device according to claim 1, the thermoactuator comprising wings, wherein the positioning of the body of the thermoactuator is ensured by the wings protruding therefrom and engaging into guide seats or columns, said positioning being attained along or parallelly to a direction of motion of the movable element.

14. A device according to claim 1, wherein the coupler includes appendices that extend from the plate.

15. A device according to claim 14, wherein the thermoactuator is mounted by inserting the thermoactuator between the appendices with a movement substantially orthogonal to an axis of motion of the slide or downwards from above, wherein the appendices are configured to stretch slightly apart in an elastic manner that that heads of the appendices clamp a body of the thermoactuator.

16. A device according to claim 1, wherein the guide structure is attached to the plate or the seat.

* * * * *